US005479381A

United States Patent [19]

Goldenberg et al.

[11] Patent Number: 5,479,381

[45] Date of Patent: Dec. 26, 1995

[54] REVERSIBLE WATCH

[76] Inventors: Jack D. Goldenberg, 201 Bayberry La., Westport, Conn. 06880; Peter Stevenson, 65 Edward St., Guilford, Conn. 06437

[21] Appl. No.: 301,615

[22] Filed: Sep. 7, 1994

[51] Int. Cl.[6] ..... G04B 19/00

[52] U.S. Cl. ..... 368/282; 224/175

[58] Field of Search ..... 368/281, 282; 224/175, 164

[56] References Cited

U.S. PATENT DOCUMENTS

| | | | |
|---|---|---|---|
| D. 282,913 | 3/1986 | Stevens | D10/33 |
| D. 294,010 | 2/1988 | Bouchet | 10/30 |
| 2,955,357 | 10/1960 | Uebelhardt | 333/72 |
| 3,293,846 | 12/1966 | Pauli | 368/281 |
| 4,108,340 | 8/1978 | Conn | 368/281 |
| 4,236,239 | 11/1980 | Imgruth et al. | 368/72 |
| 4,493,561 | 1/1985 | Bouchet | 368/281 |

*Primary Examiner*—Bernard Roskoski

[57] ABSTRACT

A reversible timepiece is provided having at least two opposite faces and at least one movement. The timepiece includes and is attached to a bi-laterally flexible watchband adapted to permit its wearer to reverse the timepiece and change from one face to the other without having to remove the timepiece from their wrist.

11 Claims, 1 Drawing Sheet

REVERSIBLE WATCH

BACKGROUND OF THE INVENTION

1. Field of the Invention

The present invention relates generally to a timepiece such as, for example, a wrist watch having two separate and opposed faces and a flexible watchband. An independent movement is provided for each face. The wrist watch may be reversed while on the wearer's wrist by twisting the flexible watch band to change the face being displayed.

2. Description of the Prior Art

The concept of providing a timepiece having two separate and distinct faces or displays is well known. For example, U.S. Pat. No. 4,236,239, which issued on Nov. 25, 1980 to Max Imgruth et al., discloses an electronic timepiece having two different displays.

Similarly, there have been a number of timepieces which have alternating faces or displays and allow the wearer to flip or otherwise turn over the display from one to another. In virtually all instances, these timepieces include elaborate and complex means which permit the faces to be pivoted from one to another. Examples of such configurations include U.S. Pat. No. 2,955,357 which issued to Roger Uebelhardt on Oct. 11, 1960 and U.S. Pat. No. 4,493,561 which issued on Jan. 15, 1985 to Jean Bouchet. See also, Swiss Patent No. 138,929 to Charles Adlof Schierwater which was published on Jun. 2, 1930; French Patent No. 712,868 to M. Rene-Alfred Chauvot which was published on Oct. 4, 1931; Swiss Patent No. 2,007,577 to Hans Ulrich Klingenberg which was published on Jan. 9, 1970; and French Patent No. 79 02771 to Yves Matthieu Saint-Laurent which was published on Aug. 8, 1980.

Similarly, there have been a number of design patents for reversible watch cases. See, for example, U.S. Pat. Des. No. 294,010 which issued on Feb. 2, 1988 to Jeach Bouchet and U.S. Des. Pat. No. 282,913 which issued on Mar. 11, 1986 to Roy E. Stevens.

In U.S. Pat. No. 3,293,846, which issued on Dec. 27, 1966 to Heinz Pauli, a bracelet timepiece is described in which two watches are mounted on opposite sides of a bracelet. See also French Patent No. 1,161,758 to M. Samuel Jack Kaufman which was published on Sep. 4, 1958 for a reversible clock.

Each of the aforementioned patents achieve reversibility by providing complicated and costly pivot means within the watch case to effect a pivoting of the watch faces.

This is in direct contrast with the present invention in which two opposed watch faces each having their own separate movement are provided with the user being able to switch from one face to the other by simply twisting the flexible band rather than by having to rely to such complicated pivot means contained in the case.

SUMMARY OF THE INVENTION

Against the foregoing background, it is a primary object of the present invention to provide a timepiece such as a wrist watch which has two separate and distinct faces.

It is another object of the present invention to provide such a timepiece in which each face has a separate movement.

It is yet another object of the present invention to provide such a timepiece in which the separate movements are mounted in back to back position relative to one other.

It is still yet another object of the present invention to provide such a timepiece which includes a flexible watch band.

It is still another object of the present invention to provide such a flexible watch band which is adapted to permit the wearer to reverse the faces of the timepiece by twisting the watch band while on the wearer's wrist.

To the accomplishments of the foregoing objects and advantages, the present invention, in brief summary, comprises a reversible timepiece having at least two opposite faces and at least one movement. The timepiece includes and is attached to a bi-laterally flexible watchband which is adapted to permit its wearer to reverse the timepiece and change from one face to the other without having to remove the timepiece from their wrist.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 2:
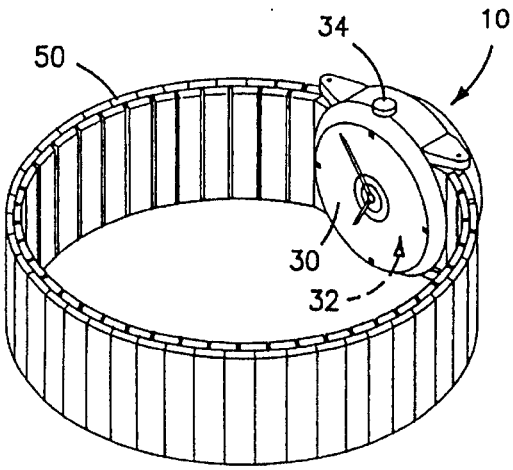
FIG. 2 is a rear perspective view of the timepiece of the present invention.
Figure 4:
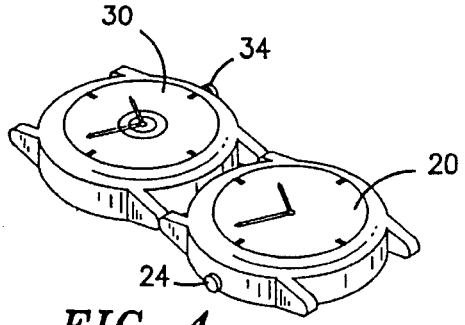
FIG. 4 is a front perspective view of the two movements and faces of the timepiece of the present invention.
Figure 5:
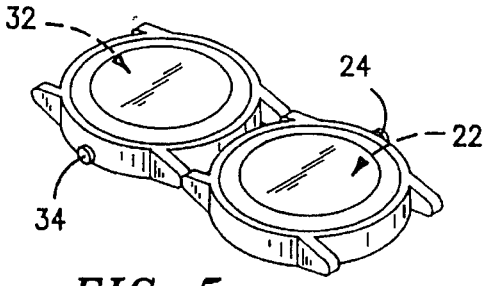
FIG. 5 is a rear perspective view of the two movements and faces of the timepiece of the present invention.
Figure 1:
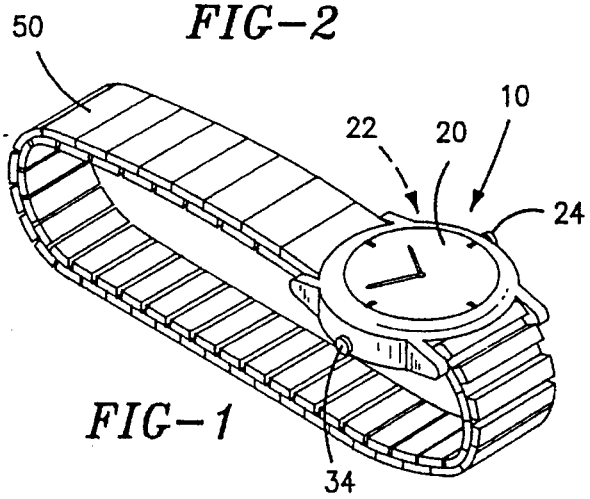
FIG. 1 is a front perspective view of the timepiece of the present invention.
Figure 3:
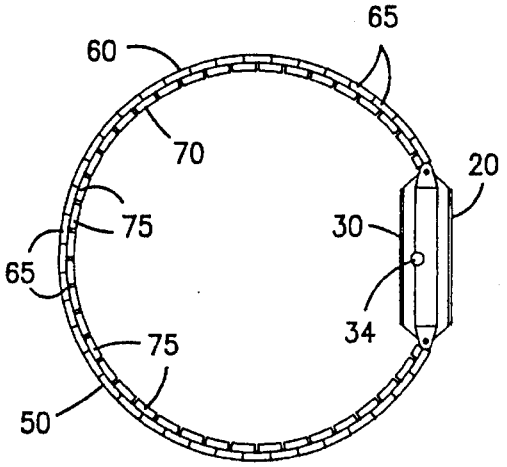
FIG. 3 is a side view of the timepiece of the present invention.

Referring to the drawings and, in particular, to FIGS. 1–4 thereof, there is provided a timepiece referred to generally by reference numeral 10. Timepiece 10, which is preferably a wristwatch, includes at least two faces 20 and 30 which are provided on opposite sides of the watch 10. As best shown in FIG. 5, each of the at least two faces 20 and 30 include a separate watch movement 22 and 32, respectively, which controls the display on the respective face 20, 30. The movements 22, 32 are mounted in juxtaposition in a back to back arrangement as shown in FIG. 3. It should be appreciated that the movements 22, 32 may be totally independent of one another or, alternatively (not shown) may comprise one movement adapted to control at least two displays. Alteratively, two separate movements may be provided which share a common power source such as, for example, a battery.

Separate control knobs 24 and 34 are provided for each movement. This permits the wearer to change the display on each face when desired. It also permits the wearer, if desired, to set the two faces at different time settings for example, to accommodate different time zones.

The individual faces 20,30 are adapted to be different in appearance to provide the wearer with a different look or fashion statement. For example, different but related character combinations may be provided on the opposite faces. Examples would include related characters such as Mickey and Minnie Mouse or Superman and Clark Kent or Batman and the Joker.

Similarly, the logos of different sports teams may be displayed on the opposite faces such as, for example, the logos of the New York Rangers and the New York Knicks. This would permit the wearer to support his or her favorite team on a day to day basis during the winter sports season. Non-character images (the sun and the moon) and/or different colors (e.g., brown and blue) may also be used on the opposite faces. This will permit the wearer to change a look of the timepiece without the need to physically change the timepiece.

The different faces may be more than merely aesthetically different. For example, one face may be set to display time in a particular time zone (e.g., Eastern Standard Time) while the other face may be set to display time in a different time zone (e.g., Pacific Standard Time). Similarly, one face may be used to digitally display time while the other face may have an analog display.

The opposite faces need not only be used to display time. For example, one face may be a timepiece while the opposite face may be an electronic game or calculator. This would, of course, permit the wearer to switch back and forth between a time display and a game.

Figure 6:
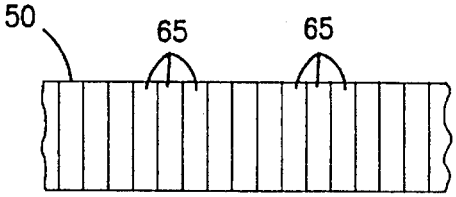
FIG. 6 is a top view of the watch band of the timepiece of the present invention in a relaxed position.
Figure 7A:
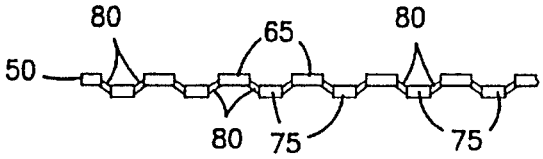
FIG. 7A is a side view of the watch band of FIG. 7 in an expanded position.
Figure 7:
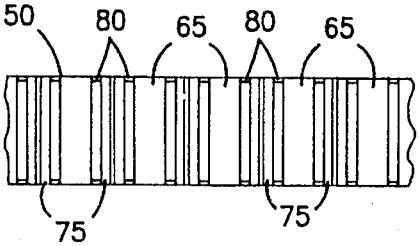
FIG. 7 is a top view of the watch band of the timepiece of the present invention in an expanded position.

Physical switching of the timepiece from one face 20 to the other 30 is facilitated by a flexible watchband 50 shown in greater detail in FIGS. 6–7. The watchband 50, which is attached to the case of the timepiece at its opposite ends, is of the flexible, resilient type which is adapted to flex and curve about a wearer's wrist. The watchband 50 must be sufficiently expansive and flexible to permit it to turn the attached timepiece over while remaining on the wearer's wrist so as to allow the wearer to change from one face on the timepiece to the other.

While this expansiveness and flexibility may be accomplished using a variety of different watchbands, a preferred watchband is illustrated in FIGS. 6–7. As shown in these figures, the watchband includes a first band 60 having a plurality of first ribs 65 interconnected to a second band 70 also having a plurality of second ribs 75.

Figure 6A:
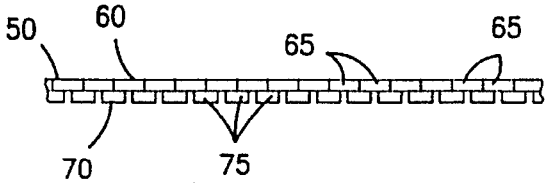
FIG. 6A is a side view of the watch band of FIG. 6 in a relaxed position.

Interconnection of the first band 60 with the second band 70 is effected by pivotally connecting the first ribs 65 to the second ribs 75 at opposite sides thereof by a pair of spring fingers 80. This permits the watch band 50 to laterally expand as shown in FIGS. 7 and 7A upon the application of an outwardly lateral force and similarly contract as shown in FIGS. 6 and 6A upon removal of that force. In this manner, the physical length of the watch band 50 may be expanded by as much as 40% from the original relaxed position (see FIG. 6).

Moreover, by providing spring fingers 80 at the outer edges of the ribs 65 and 75, the watch band 50 may not only be laterally expanded but it also may be expanded in a circular direction. This substantially increases the flexibility of the watch band 50, particularly when of the wearer's wrist.

This extreme, bi-lateral flexibility of the watch band 50 which is connected to the timepiece 10 permits the user to be able to physically reverse or rotate the timepiece while remaining on his or her wrist to alternate from one face 20 to the other 30. Thus, there is no need to physically remove the watch from one's wrist in order to change faces.

Having thus described the invention with particular reference to the preferred forms thereof, it will be obvious that various changes and modifications can be made therein without departing from the spirit and scope of the present invention as defined by the appended claims.

Wherefore, I claim:

1. A reversible timepiece having at least two opposite faces for displaying time and at least one movement, said timepiece being fixedly secured to a bilaterally flexible, continuous watchband, said watchband having a flexible first band juxtaposed to a flexible second band to permit its wearer to reverse the timepiece and change from one face to the other face without having to remove the timepiece from their wrist.

2. The timepiece of claim 1, wherein each of said faces includes an independent movement.

3. The timepiece of claim 1, wherein the faces are different in appearance.

4. The timepiece of claim 1, wherein each of said faces includes a separate control knob.

5. The timepiece of claim 1, wherein an electronic game is provided on at least one of said faces.

6. The timepiece of claim 1, wherein a calculator is provided on at least one of said faces.

7. The timepiece of claim 1, wherein said faces are mounted in a co-axial relationship.

8. The timepiece of claim 1, wherein said first band includes a plurality of first ribs and wherein said second band includes a plurality of second ribs.

9. The timepiece of claim 8, wherein said first ribs are pivotally connected to said second ribs by a pair of spring fingers provided at the outer edges of said band.

10. A reversible timepiece having at least two opposite faces for displaying time and at least one movement, said timepiece being attached to a bi-laterally flexible watchband adapted to permit its wearer to reverse the timepiece and change from one face to the other without having to remove the timepiece from their wrist, wherein said watch band includes a first band including a plurality of first ribs interconnected to a second band including a plurality of second ribs and wherein said first ribs are pivotally connected to said second ribs by spring loaded connecting means.

11. The timepiece of claim 10, wherein said spring loaded connecting means includes a pair of spring fingers provided at the outer edges of the band.

* * * * *